US005894967A

United States Patent [19]

Stahley et al.

[11] Patent Number: 5,894,967

[45] Date of Patent: Apr. 20, 1999

[54] SQUEEZE DISPENSER FOR POWDER

[75] Inventors: Robert E. Stahley, Middletown; William D. Hoenninger, Cincinnati; Liezl G. Peterson, Loveland; Dimitris Ioannis Collias, Cincinnati, all of Ohio

[73] Assignee: The Procter & Gamble Company, Cincinnati, Ohio

[21] Appl. No.: 08/739,075

[22] Filed: Oct. 28, 1996

[51] Int. Cl.[6] ..... B05B 11/06; B05B 11/00; B05B 11/02; B65D 37/00

[52] U.S. Cl. ..... 222/633; 222/630; 222/631; 222/632; 222/209; 222/211

[58] Field of Search ..... 222/633, 632, 222/631, 630, 209, 211

[56] References Cited

U.S. PATENT DOCUMENTS

| | | | |
|---|---|---|---|
| D. 278,121 | 3/1985 | Sussman | D9/352 |
| 280,202 | 6/1883 | Mattson . | |
| 2,450,205 | 9/1948 | Rose | 222/193 |
| 2,718,987 | 9/1955 | Kimball | 222/633 |
| 2,731,093 | 1/1956 | Gordon | 169/35 |
| 2,840,277 | 6/1958 | Bach | 222/193 |
| 2,896,825 | 7/1959 | Jackson | 222/211 |
| 3,428,223 | 2/1969 | Lewiecki et al. | 222/398 |
| 3,904,087 | 9/1975 | McRoskey et al. | 222/193 |
| 3,986,643 | 10/1976 | Chutter | 222/195 |
| 4,007,858 | 2/1977 | Shay | 222/193 |
| 4,091,966 | 5/1978 | Laauwe | 222/211 |
| 4,133,457 | 1/1979 | Klassen | 222/212 |
| 4,261,488 | 4/1981 | Bennett | 222/633 |
| 4,307,823 | 12/1981 | Heiss et al. | 222/633 |
| 4,356,941 | 11/1982 | McRoskey et al. | 222/632 |
| 4,513,891 | 4/1985 | Hain et al. | 222/213 |
| 4,526,305 | 7/1985 | Lykes | 222/632 |
| 4,545,510 | 10/1985 | Mettenbrink | 222/209 |
| 4,728,006 | 3/1988 | Drobish et al. | 222/181 |
| 4,730,751 | 3/1988 | Mackles et al. | 222/189 |
| 4,735,347 | 4/1988 | Schultz et al. | 222/321 |
| 4,749,108 | 6/1988 | Dornsbush et al. | 222/212 |
| 4,969,581 | 11/1990 | Seifert et al. | 222/212 |
| 5,005,737 | 4/1991 | Rohr | 222/212 |
| 5,033,655 | 7/1991 | Brown | 222/212 |
| 5,323,938 | 6/1994 | Ceccarelli et al. | 222/442 |

FOREIGN PATENT DOCUMENTS

| | | | |
|---|---|---|---|
| 9408712 | 9/1994 | Germany | B65D 83/06 |
| 1729602-A1 | 4/1992 | Russian Federation . | |
| 778768 | 7/1957 | United Kingdom . | |
| 90/14893 | 12/1990 | WIPO . | |
| WO 90/14893 | 12/1990 | WIPO . | |

*Primary Examiner*—Andres Kashnikow
*Assistant Examiner*—Keats Quinalty
*Attorney, Agent, or Firm*—William Scott Andes

[57] ABSTRACT

A powder dispenser includes a resilient container for storing a powder and a volume of air therein. The powder has properties which enable a portion of the volume of air to fluidize a portion of the powder when the resilient container is sufficiently deformed. The dispenser has a substantially rigid conduit connected to its discharge end. The conduit provides the only fluid communication between the inside of the container and an ambient outside environment. The dispenser also has a resilient flat member connected to the outer end of the conduit. The flat member has a slit that is normally closed such that the container is substantially sealed in a fluid-tight manner until the container is sufficiently deformed to generate a pressure in the volume of air. When a pressure differential exists that is greater than a threshold value, the pressure differential causes the slit to open to discharge a portion of the powder mixed with a portion of the volume of air. The dispenser may also have an apertured member in the conduit that has at least one aperture therethrough having a total cross-sectional area smaller than a cross-sectional area of the conduit. The at least one aperture provides increased air velocity and turbulence to improve mixing of powder and air.

20 Claims, 2 Drawing Sheets

SQUEEZE DISPENSER FOR POWDER

FIELD OF THE INVENTION

The present invention relates to dispensers for powders, and more particularly to such dispensers wherein the powder is moisture absorbent, therefore requiring powder protection from long term exposure to moisture contained in ambient air when the dispenser is not in use. Even more particularly, the present invention relates to squeeze dispensers having compliant discharge valves which self-seal the dispenser after fluid discharge.

BACKGROUND OF THE INVENTION

Powder dispensing is not as well understood as liquid dispensing because powder dispensing involves a two-phase fluid containing a compressible gas and solid particles. Even powders dispensed by gravity or by shaking a canister have air mixed with the solid particles. Flowability of a powder is believed to be influenced by multiple factors, including the size and shape of the particles, the tendency for particles to stick to each other, the density of particles, and the volume of air between particles. Particles may stick to each other due to electrostatic attraction as well as adhesive forces. Moisture absorbent powders in particular are prone to caking and resist flow when moisture is sufficiently absorbed. Therefore, moisture absorbing powders are typically contained in relatively air-tight dispensers so that they remain flowable for dispensing after being stored for extended periods in the presence of moist ambient air, such as often exists in a bathroom.

Moisture absorbent powders are useful in maintaining body surfaces dry and feeling soft. Where body surfaces are substantially smooth and upward facing, it is relatively easy to shake a powder from a canister onto the surface and distribute the powder evenly by using one's fingers. However, delivering powder to a body surface having hair or which faces substantially horizontal or downward is benefited by a delivery system which effectively squirts a pattern of powder onto the surface without the need for finger distribution of the powder. Spray type dispensers are generally preferred for such applications.

Squeeze type powder sprayers are known in the art. In one version a resilient bulb is squeezed to cause a burst of air to flow past a container of powder. The powder is drawn into and mixed with the airstream, presumably because the movement of the air generates a low pressure zone adjacent the powder surface. Bulb type powder dispensers are typically limited to very low powder doses.

Squeezebottles which contain powder and have an air headspace are another version, wherein powder is discharged by squeezing the bottle to cause headspace air to push a portion of powder and air out of the bottle. Air pressure may force the powder out an open orifice as in U.S. Pat. No. 2,450,205 to Rose or U.S. Pat. No. 2,840,277 to Bach. One disadvantage of these prior art dispensers is that their discharge orifices are always open, thereby exposing contained powder to moisture. Prior art references show removable closures for powder dispensers, but such closures may not be replaced after spraying, and therefore are not fool-proof In the liquid dispensing art there are found references having squeezebottle dispensers with resilient self-sealing valves. An example is U.S. Pat. No. 4,749,108 to Dornsbusch et al. Dornsbusch et al. show a normally concave-shaped resilient slit valve which inverts under sufficient internally developed pressure. Because this slit valve is intended to seal the container from liquid dripping, the slit must close tightly. Valve inversion causes the slit to close more tightly until it finally opens. Thus, a liquid head in a downward pointing bottle would not result in valve leakage. However, the need for the valve to invert generally requires that a high internal pressure be developed. If such a valve were used with powder instead of liquid, a virtual explosion of powder would occur once the valve opened because compressed air would burst through with the powder. Where targeted delivery of a fine powder is desired, such an explosion is disadvantageous because it results in a significant "cloud of dust" or wasted, non-targeted powder.

Other references, such as publication WO 90/14893, dealing with compressible fluid spray nozzles other than for squeezebottle dispensers, show resilient flat valves, which operate at much higher pressures than inverting valves. If such a valve could be applied to a squeezebottle powder dispenser, both self-sealing and targeted powder delivery could possibly be achieved.

Diptubes are used with squeezebottle powder dispensers intended for upright dispensing. Although powder flowing through a diptube adds to the internal air pressure needed to be developed in a squeezebottle to initiate powder dispensing, the diptube is necessary to provide a path for powder to flow upward to the discharge opening. Without a diptube, air compressed in the squeezebottle headspace would merely exit without carrying powder with it. However, diptubes provide an opportunity for powder plugging if a powder should become compacted in the diptube. The ideal powder has the ability to easily mix with air and flow through the diptube without compacting for proper functioning.

The hereinbefore mentioned Bach reference has a diptube leading from the bottom of the bottle to a mixing chamber just ahead of a discharge orifice. The mixing chamber has a separate opening for a portion of the headspace air to enter the mixing chamber. Although a mixing chamber is advantageous for obtaining a uniform distribution of powder in air, a separate opening to the mixing chamber is believed disadvantageous because it enables headspace air to exit the dispenser without first pushing powder up the diptube. Substantial variation in powder volume dispensed may result from each squeeze actuation of the dispenser if headspace air can escape other than through the bulk of the powder in the bottle.

OBJECTS OF THE INVENTION

It is an object of the present invention to provide a powder dispenser having a compliant discharge valve which opens under minimum air pressure to deliver a powder spray in a targeted fashion without generating a significant dust cloud outside the dispenser, yet self-closes such that the squeeze dispenser is substantially sealed after each powder discharge.

It is another object of the present invention to provide a powder dispenser which operates in any orientation from substantially horizontal to upright.

It is yet another object of the present invention to provide a powder dispenser having a mixing chamber connected to a diptube, which extends to near the bottom of the dispenser, such that the diptube is the only path for both air and powder to flow to the mixing chamber.

SUMMARY OF THE INVENTION

In one aspect of the present invention, a powder dispenser comprises a resilient container having a discharge end and an inside for storing a powder and a volume of air therein. The powder has properties which enable a portion of the volume of air to fluidize a portion of the powder when the resilient container is sufficiently deformed. The dispenser also comprises a substantially rigid conduit connected to the discharge end of the resilient container. The conduit has an inside end and an outside end. The conduit provides the only fluid communication between the inside of the resilient container and an ambient environment outside the resilient container.

The dispenser may further comprise a resilient flat member connected to the outside end of the conduit. The resilient flat member has a slit therein. The slit is normally closed such that the resilient container is substantially sealed in a fluid-tight manner until the resilient container is sufficiently deformed to generate a pressure in the volume of air. When a pressure differential exists between the volume of air and the ambient environment, and the pressure differential is greater than a threshold value, the pressure differential causes the slit to open, and thereby discharge a portion of the powder mixed with a portion of the volume of air.

The dispenser may further comprise an apertured member interposed in the conduit between the inside end and the outside end. The apertured member may have at least one aperture therethrough having a total cross-sectional area smaller than a cross-sectional area of the conduit. The at least one aperture provides increased air velocity and turbulence to improve mixing of a portion of the powder with a portion of the volume of air. The apertured member is preferably located nearest the outside end of the conduit to provide a shelf upon which a portion of the powder may reside when the resilient container is oriented substantially upright. That portion of the powder serves as a prime which quickly exits the conduit when the resilient container is first sufficiently deformed. The apertured member effectively forms a mixing chamber between the apertured member and the resilient flat member. Unlike many prior art dispensers, the volume of air and the powder have access to the mixing chamber only through the at least one aperture in the apertured member located inside the substantially rigid conduit.

In another aspect of the present invention, a powder dispenser for directing a spray of powder in a direction ranging from substantially upward to substantially horizontal comprises a resilient container having a discharge end and a powder and a volume of air therein. The powder has a packed bulk density ranging from about 0.2 grams per cubic centimeter to about 0.5 grams per cubic centimeter and an aerated bulk density ranging from about 0.1 grams per cubic centimeter to about 0.3 grams per cubic centimeter. The dispenser also has a substantially rigid conduit connected to the discharge end of the resilient container. The conduit has an inside end and an outside end, and the conduit provides the only fluid communication between the inside of the resilient container and an ambient environment outside the resilient container.

The powder may have a particle size ranging from about 1 micron to about 100 microns, and more preferably from about 1 micron to about 60 microns, and most preferably from about 1 micron to about 20 microns; an angle of repose ranging from about 40 degrees to about 50 degrees; an angle of fall ranging from about 20 degrees to about 35 degrees; and an angle of difference ranging from about 15 degrees to about 25 degrees; so that fluidizing the portion of the powder requires minimal air velocity.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
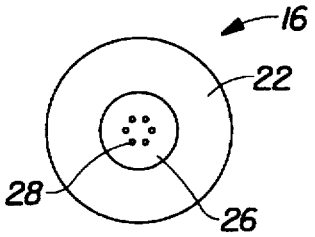
FIG. 1 is a top plan view of a powder conduit of the present invention, showing an annular flange and a plurality of apertures in an apertured member.
Figure 3:
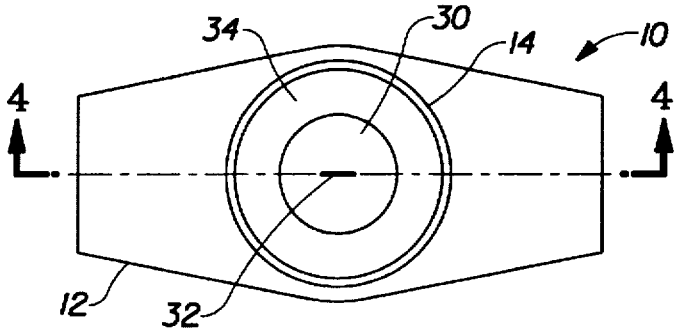
FIG. 3 is a top plan view of a squeezebottle dispenser containing the conduit, disclosing a self-seal slit valve for powder discharge.
Figure 2:
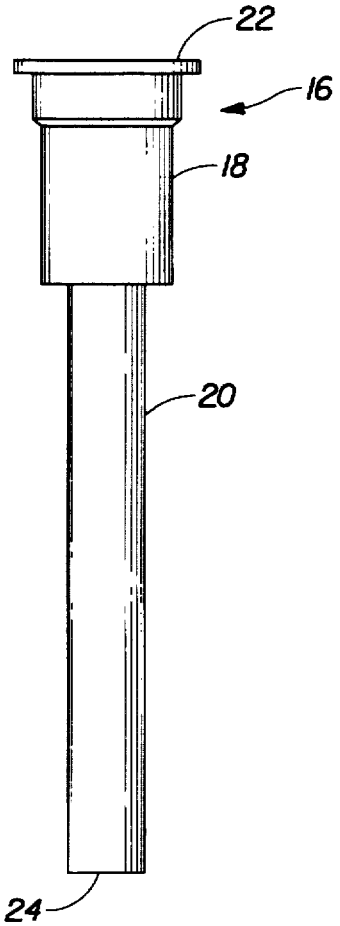
FIG. 2 is a side elevation view thereof, disclosing a flange, a sidewall of the mixing chamber, and a diptube supported from the bottom end of the chamber.
Figure 4:
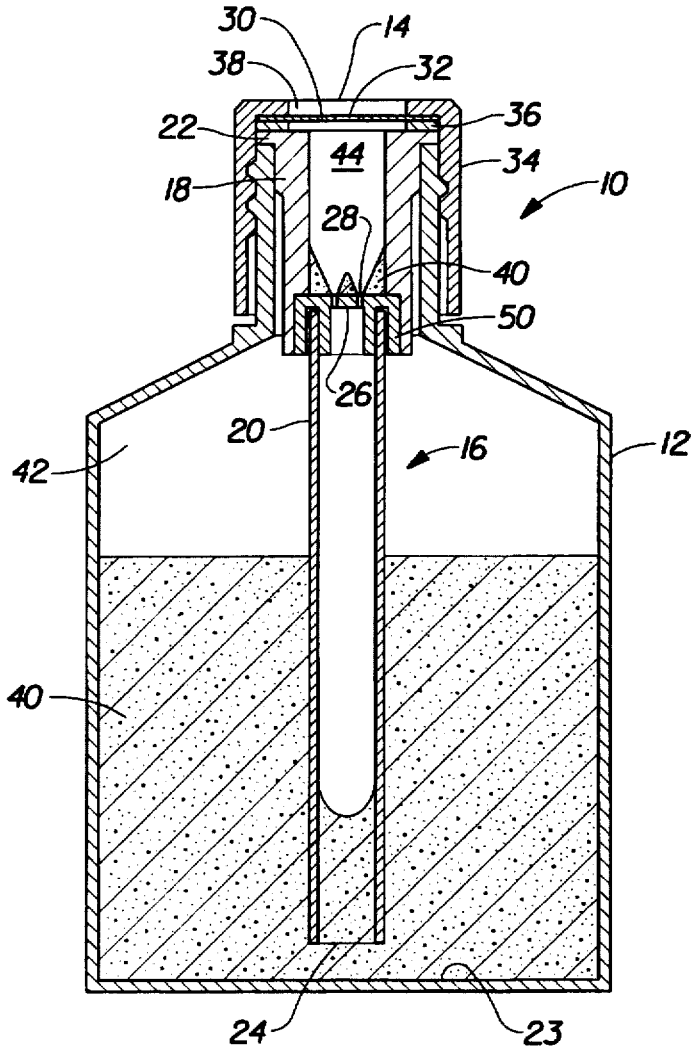
FIG. 4 is a sectioned side elevation view thereof, taken along section line 4—4 of FIG. 3, showing the slit valve located atop the flange of the conduit and the conduit located within the squeezebottle, with a typical powder settled in the squeezebottle after an initial powder discharge.

Referring now to the drawings, and more particularly to FIGS. 1–4, there is shown a preferred embodiment of the present invention, which provides a squeezebottle powder dispenser, and is generally indicated as 10. Dispenser 10 has a resilient container 12 and a discharge end 14. Mounted to discharge end 14 is a substantially rigid conduit, which is generally indicated as 16. As shown in FIGS. 2 and 4, conduit 16 has a fitment 18 at one end and a substantially squared-off diptube 20 at the other end. Fitment 18 is preferably shaped to press-fit into the finish of resilient container 12. Fitment 18 preferably has a flange which forms an outside end 22 of conduit 16. Diptube 20 is preferably permanently connected to fitment 18, such as by interference fit, and it extends from fitment 18 to near an inside bottom surface 23 of resilient container 12 to form an inside end 24 of conduit 16.

FIGS. 1 and 4 show fitment 18 having an apertured member 26, which is preferably a rigid plate perpendicular to the axis of fitment 18. Apertured member 26 has at least one aperture 28 therethrough, which has a cross-sectional area less than that of the inside of diptube 20. A plurality of apertures 28 similarly have a combined cross-sectional area less than that of the inside of diptube 20. The purpose of apertured member 26 and aperture(s) 28 is to increase the velocity of air flowing through diptube 20 near discharge end 14 so that better mixing of air and powder occurs just before discharge. Apertured member 26 also forms a shelf upon which residual powder from a previous dispensing cycle may rest when container 12 is oriented upright. The powder on the shelf acts as a prime, such that when the container is first squeezed and sufficient air pressure is developed inside the container to lift powder through the diptube, powder is immediately ready for discharge. A second apertured member, such as a screen, which is not shown, may be located above apertured member 26 to further increase mixing and to act as an additional shelf.

FIGS. 3 and 4 show discharge end 14 of dispenser 10 having a resilient flat member 30 covering outside end 22 of conduit 16. Resilient flat member 30 has a short slit 32 near the center of flat member 30. Flat member 30 is preferably made of a thin compliant material so that slit 32 opens under minimal pressure differential developed inside container 12. Slit 32 is preferably straight and shorter in length than the inside diameter of outside end 22 of conduit 16. Slit 32 serves as a discharge valve for dispenser 10. Slit 32 is normally closed and self-seals container 12 from the ambient environment outside dispenser 10.

Flat member 30 is preferably held in place against outside end 22 by a threaded closure 34, which engages threads on the finish of container 12. Inside threaded closure 34 may be placed a substantially rigid annular member 36 which clamps flat member 30 against the inside of closure 34. Having annular member 36 inside closure 34 isolates from flimsy flat member 30 the twisting and compression forces generated by applying closure 34 against outside end 22. Such isolation is beneficial so that flat member 30 is not distorted when closure 34 is installed. Closure 34 has an opening 38 centered therein about the same size as an opening in annular member 36. Opening 38 is sized so that powder and air dispensed from slit 32 in a conical or fan-shaped pattern have clearance and are not restricted by the closure.

FIG. 4 shows a powder 40 and a volume of headspace air 42 above powder 40 inside container 12 and diptube 20. Powder 40 is also shown resting above apertured member 26. This is the condition of a powder dispenser of the present invention after an initial dispensing cycle and just before the next squeeze. After the initial cycle, wherein resilient sidewalls of container 12 are squeezed to dispense powder and air, the sidewalls are released. When the sidewalls are released, they return to their original shape and in doing so draw a vacuum inside container 12. The vacuum is sufficient to open slit 32 to allow replacement air into container 12. Since the only path for air and powder into and out of container 12 is through conduit 16, air and powder are sucked back down diptube 20. Thus, the level of powder shown in diptube 20 is usually different than the level of powder shown in the rest of container 12.

The space between apertured member 26 and flat member 30 forms a mixing chamber 44 wherein a portion of powder 40 and a portion of volume of air 42 may mix before being discharged through slit 32. Such mixing is beneficial in providing a consistent mixture during the discharge. That is, mixing avoids spurting of clumps of powder. Apertured member 26 is preferably nearer flat member 30 than inside end 24 of conduit 16.

Figure 5:
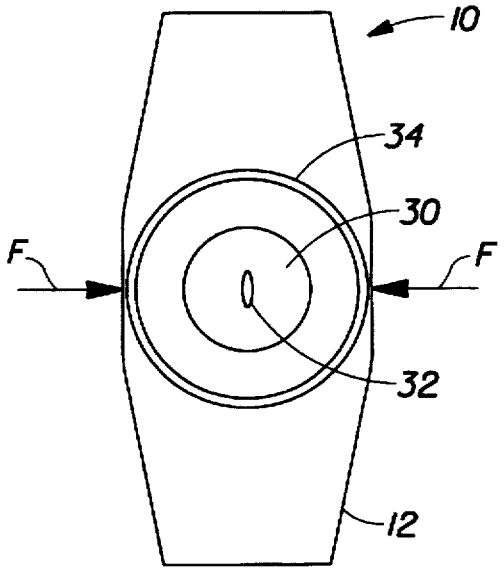
FIG. 5 is a top plan view of the dispenser of FIG. 4, showing the sides of the squeezebottle being squeezed and the slit valve being opened after a threshold pressure developed inside the bottle has been reached.
Figure 6:
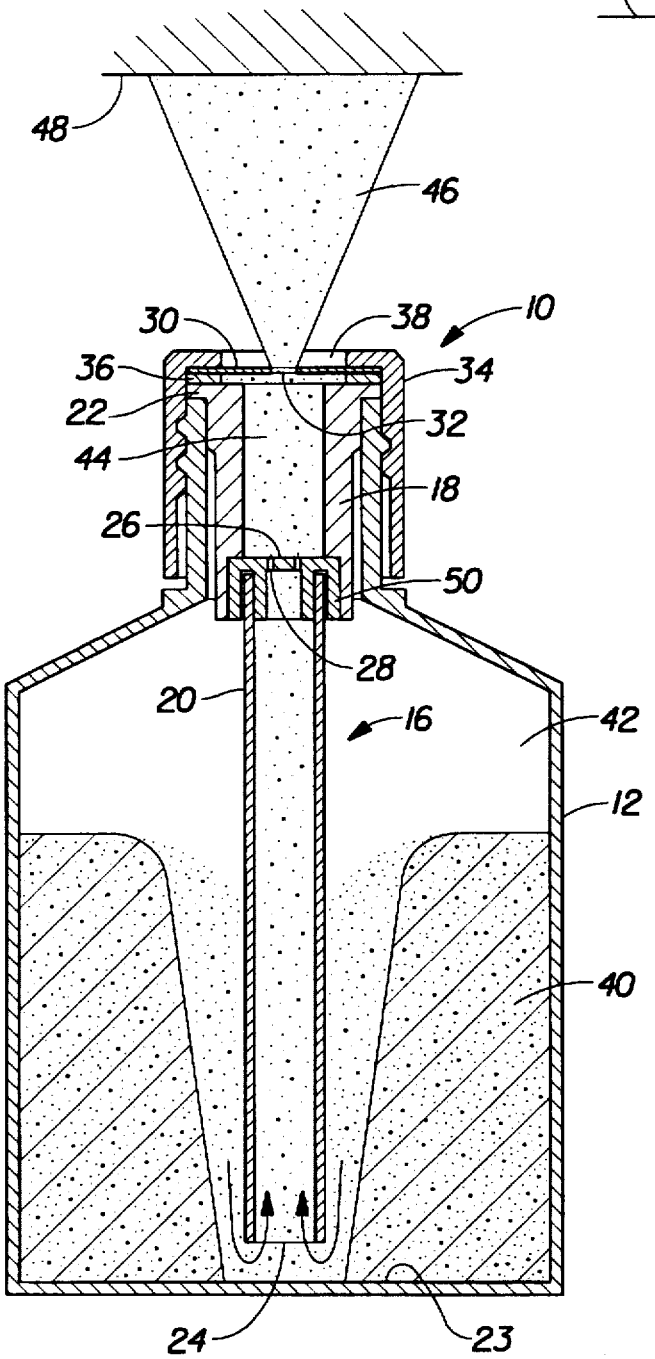
FIG. 6 is a sectioned side elevation view similar to FIG. 4, showing the location of powder when the squeezebottle is squeezed to cause a discharge.

FIGS. 5 and 6 show dispenser 10 in a condition in which the sidewalls of container 12 are squeezed to cause powder 40 and air 42 to discharge. Air 42 from the headspace above powder 40 is compressed by squeezing the container sidewalls to generate a differential pressure compared to ambient air outside dispenser 10. Since the only path for discharging air 40 is via diptube 20, air fluidizes a portion of powder 40 as it rushes to inside end 24 of conduit 16. Fluidized air and powder are than lifted upward in diptube 20 and through apertured member 26 into mixing chamber 44, from which the mixture discharges through slit 32. FIG. 5 shows squeeze force F applied to the sidewalls and slit 32 opened. FIG. 6 shows a conical or fan-shaped spray 46 of powder and air directed at a target surface 48 parallel to flat member 30. The properties of powder 40 and of target surface 48 enable the spray 46 to substantially remain on target surface 48, which is preferably the human body when powder 40 is a moisture absorbing powder. Because of the low threshold pressure differential necessary to open slit 32, minimal dust cloud of small particles is generated around spray 46.

In a most preferred embodiment of the present invention, dispenser 10 is intended for dispensing a powder 40 having a packed bulk density ranging from about 0.2 grams per cubic centimeter to about 0.5 grams per cubic centimeter and an aerated bulk density ranging from about 0.1 grams per cubic centimeter to about 0.3 grams per cubic centimeter. This powder has a particle size ranging from about 1 micron to about 100 microns, and more preferably from about 1 micron to about 60 microns, and most preferably from about 1 micron to about 20 microns; an angle of repose ranging from about 40 degrees to about 50 degrees; an angle of fall ranging from about 20 degrees to about 35 degrees; and an angle of difference ranging from about 15 degrees to about 25 degrees. Powder characteristics are measured by using a Powder Characteristics Tester Model PT-N, made by Micron Powder Systems of Summit, N.J.

An example of a preferred powder is a mixture by weight of 37.7% low moisture cornstarch, 20% calcium silicate, 5% fumed silica, 10% silica microspheres, 8% magnesium carbonate, 5% dimethicone, 3% nylon N-12, 3% zinc stearate, 3% zinc phenolsulphonate, 0.2% triclosan, 0.1% Aloe Vera, 2% encapsulated tocopheryl acetate, and 3% beta cyclodextrin.

Resilient container 12 is preferably an oval, six fluid ounce capacity, polyolefin bottle, such as an Oil of Olay Beauty Fluid bottle, made by The Procter & Gamble Company of Cincinnati, Ohio. However, shape of the squeeze-bottle is not limited. It could be round or other shape, tall or short, as long as the deformation of the bottle produces sufficient air pressure differential to lift the powder through the conduit and open the slit valve. The range of powder dispensed per typical squeeze cycle varies in a full to empty dispenser from about 0.20 gm to about 0.02 gm. The preferred air headspace when the container is "full" is about 20% of the bottle volume. The lower the percent headspace, the more likely the conduit is to plug upon repeated squeezes.

Fitment 18 is preferably molded of polypropylene, and is about 2.5 cm long and about 2.2 cm diameter at the flange, with an internal diameter of mixing chamber 44 being about 12 mm. Mixing chamber 44 is preferably about 18 mm deep. Although fitment 18 and diptube 20 could possibly be formed as a single part, different sized diptubes are useful if they are connected to the fitment by an adapter 50, as shown in the FIGS. 4 and 6. Different sized diptubes are beneficial when powder properties are changed. For example, a lighter density powder will function with a smaller diameter diptube without clogging, whereas a heavier density powder may require a larger diameter diptube. For the preferred powder, a diptube made of polypropylene and having an inner diameter of about 0.35 inches (8 mm) is preferred. Diptube 20 extends about 9.7 cm from fitment 18 to within about 0.25 inches (6 mm) of the inside bottom surface of container 12. It is believed that these dimensions provide sufficient air velocity at the inside end of conduit 16 to lift a portion of powder 40 through the conduit to the outside end 22 when the powder dispenser is operated in a substantially upright orientation. It is further believed that orientation of the dispenser from horizontal to near upright does not require as high an air velocity as does the upright orientation. The larger the conduit internal diameter, the greater the air displacement needed with each squeeze of the container in order to lift powder through the conduit. Also, the larger the conduit outside diameter, the smaller the squeeze stroke available. Thus, an optimum conduit diameter depends upon container shape and size and powder properties. The ideal gap between the end of the diptube and the bottom inside surface of the bottle will also vary with diptube internal diameter.

Apertured member 26 is conveniently located in conduit 16 by use of an adaptor between the diptube and fitment. Adapter 50 is preferably molded of polypropylene and is sized to secure itself and the diptube into fitment 18 by interference fit. Alternatively, conduit 16 could be made of materials which could be snapped, adhesively bonded, or welded together, or fabricated from a single piece of material. Preferably member 26 has six evenly spaced apertures 28 therein of about 1 mm diameter each. Member 26 is about 0.5 mm thick where the apertures are located. Having apertured member 26 in conduit 16 is beneficial for air and powder mixing and providing a prime, but it is not necessary for dispenser 10 to function. Having a constant diameter conduit 16 leading to resilient flat member 30 is functional but not optimal for the preferred powder.

A feature of the present invention is a mixing chamber having only one entrance for both powder and air. Both powder and air rise through the diptube and apertured member to the mixing chamber. This arrangement is preferred for the light density powders intended to be dispensed by the present invention. For heavier density powders, such as those containing primarily talc, it has been found that providing one or more separate passages through the side of fitment 18, for a small portion of headspace air to flow into the mixing chamber, improves dispensing. Such passage or passages may be beneficial for dispensers intended to be used in an upside down orientation in order to provide a path other than the diptube for powder to flow into the mixing chamber. Dispensing of heavier density powders and upside down dispensing are not intended for the present invention, however, such operation may be facilitated by the addition of separate passages into the mixing chamber.

Resilient flat member 30 is made of approximately 0.030 inch thick silicone rubber having a durometer of approximately 30 Shore A. Slit 32 is linear along a diameter of flat member 30 and has a length of approximately 0.25 inches or 6 mm, such that a discharge spray 46 provides a substantially round powder pattern at external target surface 48, assuming the target surface is substantially parallel to the resilient flat member. Other lengths of slit, thicknesses of flat member, etc., may result in other useful spray patterns. With the preferred dimensions and material properties of flat member 30, the threshold pressure ranges from about 0.5 pounds per square inch to about 3 pounds per square inch, so that a burst of air and powder discharges at a sufficiently low velocity to avoid a substantial dust cloud of fine particles.

A threaded closure 34 is shown clamping flat member 30 to flanged outside end 22 of conduit 16. Alternative closures could be used or the flat member could be formed as an integral part of the fitment.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A powder dispenser comprising:

a) a resilient container having an inside for storing a powder and a volume of air therein, said resilient container also having a discharge end;

b) a substantially rigid conduit connected to said discharge end of said resilient container, said conduit having an inside end and an outside end, said conduit providing the only fluid communication between said inside of said resilient container and an ambient environment outside said resilient container; and c) a resilient flat member connected to said outside end of said conduit, said resilient flat member having a slit therein, said slit being normally closed such that said resilient container is substantially sealed in a fluid-tight manner until said resilient container is sufficiently deformed to generate a pressure in said volume of air such that a pressure differential exists between said volume of air and said ambient environment and said pressure differential is greater than a threshold value, said pressure differential causing said slit to open.

2. The powder dispenser of claim 1 further comprising an apertured member interposed in said conduit between said inside end and said outside end, said apertured member having at least one aperture therethrough, said at least one aperture having a total cross-sectional area smaller than a cross-sectional area of said conduit, said at least one aperture providing increased air velocity to improve mixing of a portion of said powder with a portion of said volume of air.

3. The powder dispenser of claim 2 wherein said apertured member is located nearest said outside end, said apertured member providing a shelf upon which a portion of said powder may reside when said resilient container is oriented substantially upright, said portion of said powder serving as a prime that quickly exits said conduit when said resilient container is first sufficiently deformed.

4. The powder dispenser of claim 2 wherein said apertured member forms a mixing chamber between said apertured member and said resilient flat member, said portion of said volume of air and said portion of said powder having access to said mixing chamber only through said at least one aperture in said apertured member located inside said substantially rigid conduit.

5. The powder dispenser of claim 1 wherein said threshold value ranges from about 0.5 pounds per square inch to about 3 pounds per square inch, so that a burst of said powder discharges at a sufficiently low velocity to avoid a substantial dust cloud of fine particles.

6. The powder dispenser of claim 1 wherein said conduit has an inner diameter of approximately 0.35 inches and said inside end of said conduit is located approximately 0.25 inches from said inside of said resilient container, said dimensions providing sufficient air velocity at said inside end of said conduit to lift a portion of said powder through said conduit to said outside end when said powder dispenser is operated in a substantially upright orientation.

7. The powder dispenser of claim 1 wherein said resilient flat member is made of approximately 0.030 inch thick silicone rubber having a durometer of approximately 30 Shore A, and said slit is linear and has a length of approximately 0.25 inches, such that a discharge of said portion of said powder and said portion of said volume of air provides a substantially round powder pattern at an external target surface substantially parallel to said resilient flat member.

8. A powder dispenser comprising:

a) a resilient container having an inside for storing a powder and a volume of air therein, said resilient container also having a discharge end, said powder having properties which enable a portion of said volume of air to fluidize a portion of said powder when said resilient container is sufficiently deformed;

b) a substantially rigid conduit connected to said discharge end of said resilient container, said conduit having an inside end and an outside end, said conduit providing the only fluid communication between said inside of said resilient container and an ambient environment outside said resilient container, whereby a mixture of said portion of said powder and said portion of said volume of air is dispensed from said outside end when said resilient container is sufficiently deformed; and c) an apertured member interposed in said conduit between said inside end and said outside end, said apertured member having at least one aperture therethrough, said at least one aperture having a total cross-sectional area smaller than a cross-sectional area of said conduit, said at least one aperture providing increased air velocity to improve mixing of a portion of said powder with a portion of said volume of air.

9. The powder dispenser of claim 8 further comprising a resilient flat member connected to said outside end of said conduit, said resilient flat member having a slit therein, said slit being normally closed such that said resilient container is substantially sealed in a fluid-tight manner until said resilient container is sufficiently deformed to generate a pressure in said volume of air such that a pressure differential exists between said volume of air and said ambient environment and said pressure differential is greater than a threshold value, said pressure differential causing said slit to open.

10. The powder dispenser of claim 9 wherein said threshold value ranges from about 0.5 pounds per square inch to about 3 pounds per square inch, so that a burst of said powder discharges at a sufficiently low velocity to avoid a substantial dust cloud of fine particles.

11. The powder dispenser of claim 8 wherein said apertured member is located nearest said outside end, said apertured member providing a shelf upon which a portion of said powder may rest when said resilient container is oriented substantially upright, said portion of said powder serving as a prime that quickly exits said conduit when said resilient container is first sufficiently deformed.

12. The powder dispenser of claim 8 wherein said apertured member forms a mixing chamber between said apertured member and said resilient flat member, said portion of said volume of air and said portion of said powder having access to said mixing chamber only through said at least one aperture in said apertured member located inside said substantially rigid conduit.

13. The powder dispenser of claim 8 wherein said conduit has an inner diameter of approximately 0.35 inches and said inside end of said conduit is located approximately 0.25 inches from said inside of said resilient container, said dimensions providing sufficient air velocity at said inside end of said conduit to lift a portion of said powder through said conduit to said outside end when said powder dispenser is operated in a substantially upright orientation.

14. The powder dispenser of claim 8 wherein said powder has a packed bulk density ranging from about 0.2 grams per cubic centimeter to about 0.5 grams per cubic centimeter and an aerated bulk density ranging from about 0.1 grams per cubic centimeter to about 0.3 grams per cubic centimeter.

15. The powder dispenser of claim 8 wherein said powder has a particle size ranging from about 1 micron to about 100 microns, an angle of repose ranging from about 40 degrees to about 50 degrees, an angle of fall ranging from about 20 degrees to about 35 degrees, and an angle of difference ranging from about 15 degrees to about 25 degrees, so that fluidizing said portion of said powder requires minimal air velocity.

16. A powder dispenser for directing a spray of powder in a direction ranging from substantially upward to substantially horizontal, said powder dispenser comprising:

a) a resilient container having a powder and a volume of air therein, said resilient container also having a discharge end, said powder having a packed bulk density ranging from about 0.2 grams per cubic centimeter to about 0.5 grams per cubic centimeter and an aerated bulk density ranging from about 0.1 grams per cubic centimeter to about 0.3 grams per cubic centimeter; and b) a substantially rigid conduit connected to said discharge end of said resilient container, said conduit having an inside end and an outside end, said conduit providing the only fluid communication between said inside of said resilient container and an ambient environment outside said resilient container.

17. The powder dispenser of claim 16 wherein said powder has a particle size ranging from about 1 micron to about 100 microns, an angle of repose ranging from about 40 degrees to about 50 degrees, an angle of fall ranging from about 20 degrees to about 35 degrees, and an angle of difference ranging from about 15 degrees to about 25 degrees, so that fluidizing said portion of said powder requires minimal air velocity.

18. The powder dispenser of claim 16 wherein said conduit has an inner diameter of approximately 0.35 inches and said inside end of said conduit is located approximately 0.25 inches from said inside of said resilient container, said dimensions providing sufficient air velocity at said inside end of said conduit to lift a portion of said powder through said conduit to said outside end when said powder dispenser is operated in a substantially upright orientation.

19. The powder dispenser of claim 16 further comprising a resilient flat member connected to said outside end of said conduit, said resilient flat member having a slit therein, said slit being normally closed such that said resilient container is substantially sealed in a fluid-tight manner until said resilient container is sufficiently deformed to generate a pressure in said volume of air such that a pressure differential exists between said volume of air and said ambient environment and said pressure differential is greater than a threshold value, said pressure differential causing said slit to open.

20. The powder dispenser of claim 16 further comprising an apertured member interposed in said conduit between said inside end and said outside end, said apertured member having at least one aperture therethrough, said at least one aperture having a total cross-sectional area smaller than a cross-sectional area of said conduit, said at least one aperture providing increased air velocity to improve mixing of a portion of said powder with a portion of said volume of air.

* * * * *